US008748163B2

(12) United States Patent
Mihai et al.

(10) Patent No.: US 8,748,163 B2
(45) Date of Patent: Jun. 10, 2014

(54) METHOD FOR PAPER TREATMENT WITH ENZYME

(75) Inventors: Nicoleta Mihai, Oakville (CA); Guiqin Song, Milton (CA); Valerie Farrugia, Oakville (CA); T. Brian McAneney, Burlington (CA)

(73) Assignee: Xerox Corporation, Norwalk, CT (US)

( * ) Notice: Subject to any disclaimer, the term of this patent is extended or adjusted under 35 U.S.C. 154(b) by 241 days.

(21) Appl. No.: 13/235,119

(22) Filed: Sep. 16, 2011

(65) Prior Publication Data

US 2013/0071911 A1 Mar. 21, 2013

(51) Int. Cl.
*D06M 16/00* (2006.01)

(52) U.S. Cl.
USPC ..... 435/264; 399/341; 399/342; 510/305; 510/365

(58) Field of Classification Search
None
See application file for complete search history.

(56) References Cited

U.S. PATENT DOCUMENTS

| | | | |
|---|---|---|---|
| 7,579,394 | B2 | 8/2009 | Song et al. |
| 7,744,977 | B2 | 6/2010 | Simonsohn et al. |
| 7,754,812 | B2 | 7/2010 | Song et al. |
| 7,906,581 | B2 | 3/2011 | Lee et al. |
| 2008/0057433 | A1 | 3/2008 | Anderson et al. |
| 2008/0248196 | A1 | 10/2008 | Anderson et al. |
| 2008/0274420 | A1 | 11/2008 | Song et al. |
| 2009/0104373 | A1 | 4/2009 | Vanbesien et al. |
| 2009/0184157 | A1 | 7/2009 | Sisler et al. |
| 2010/0112315 | A1 | 5/2010 | Song et al. |

OTHER PUBLICATIONS

Felby et al., Enzyme and Microbial Technology, 2002, vol. 31, p. 736-741.*

Felby et al., Industrial Crops and Products, 2004, vol. 20, p. 181-189.*

NPL search results, Oct. 1, 2013.*

Green et al. 2003, "Paper Needs of Xerographic machines, a summary" 4 pages of PDF.*

* cited by examiner

*Primary Examiner* — Kade Ariani

(74) *Attorney, Agent, or Firm* — MH2 Technology Law Group LLP

(57) ABSTRACT

Exemplary embodiments provide methods for treating a xerographic printed substrate with an enzyme solution to increase the surface free energy of the substrate. Other exemplary embodiments provide methods for making an adhesive medium with an enzyme-treated substrate.

18 Claims, 4 Drawing Sheets

METHOD FOR PAPER TREATMENT WITH ENZYME

DETAILED DESCRIPTION

1. Field of Use

The present teachings relate generally to adhesive media and, more particularly, to adhesive media including an enzyme treatment to degrade surface hydrocarbons.

2. Background

In conventional xerography, electrostatic latent images are formed on a xerographic surface by uniformly charging a charge retentive surface, such as a photoreceptor. The charged area is then selectively dissipated in a pattern of activating radiation corresponding to the original image. The latent charge pattern remaining on the surface corresponds to the area not exposed by radiation. Next, the latent charge pattern is visualized by passing the photoreceptor by one or more developer housings comprising thermoplastic toner, which adheres to the charge pattern by electrostatic attraction. The developed image is then fixed to the imaging surface or is transferred to a receiving substrate, such as paper, to which it is fixed by a suitable fusing technique involving the application of heat, resulting in a xerographic print or toner-based print.

To ensure and maintain good release properties of the fuser roll, it has become customary to apply release agents to the fuser roll during the fusing process. These materials are applied as thin films of low surface energy liquids, for example, nonfunctional silicone oils or mercapto- or amino-functional silicone oils, to prevent toner offset.

The mechanism involved in the use of thin liquid films of fuser oils in two roll fuser systems to ensure release between the fuser roll surface and the thermoplastic toner is a dynamic cohesive failure or film splitting of the release oil in the diverging roll nip exit, leaving a barrier of fuser oil on both the roll and the toner image surfaces. The residual film of release oil on the fused toner image and paper, which is referred to herein as oil contamination, can cause problems with subsequent, end-use applications involving wetting or adhesion. After printing, images may experience a number of process treatments involving wetting and adhesion, including coating (e.g., overprint varnish application), lamination, application of adhesives (e.g., book-binding, Post-It® notes, and pressure, mail sealers), and thermal transfer printing (e.g., check post-encoding). Residual fuser oil present on the print image surface, typically as a film covering the print image as well as the paper substrate, results in low surface energy of the print and substrate, respectively. Attempts to wet and adhere materials across this low energy surface results in numerous well-known surface tension related coating defects including pinholes, craters and reticulation for coating liquids and subsequent dried films; failure to achieve fiber tear when adhesive is applied to produce a joint as in the case of book-binding or lamination; and missing information in the case of thermal transfer printing. It has been shown that certain amino-functionalized fuser oils exhibit these problems to a greater extent than other release oils. For example, amino-functionalized poly(dimethylsiloxane) (PDMS) fuser oils are particularly problematic due to hydrogen bonding at the paper/oil interface, which restricts the oil's ability to diffuse below the substrate surface. The fuser oil therefore remains on the print image and the paper substrate surface, significantly reducing the surface free energy (SFE) of both the toner image and paper.

A number of prior solutions to these end-use application problems have been proposed, such as U.S. Patent Publication No. 2010/0196682, which is hereby incorporated by reference in its entirety. This solution involves, treating contaminated paper with a combination of ultraviolet (UV) radiation and ozone. Other conventional solutions include U.S. Patent Publication No. 2008-0057433, U.S. Pat. Nos. 7,579,394, 7,754,812, 7,906,581, 7,744,977, U.S. Patent Publication Nos. 2008-0248196, 2008-0274420, 2009-0104373, 2009-0184157 and 2010-0112315, all of which are hereby incorporated by reference in their entireties. These solutions involve a modification of the adhesive or coating material to improve adhesion on oil contaminated prints or the inclusion of an additional coating to act as a coupling or tie-coat layer. Consequently, these solutions are application specific; in contrast, this disclosure directly addresses improved adhesion properties of oil-contaminated prints potentially for all end-use applications. Further conventional solutions include a "scrubbing bubbles" approach by applying a surfactant to the oil-contaminated surface with mechanical scrubbing. However, some surfactants can present environmental risks or are known to be toxic to humans, animals, and/or the ecosystem. Mechanical scrubbing can also adversely affect substrate integrity and requires additional machinery, which increases end-product costs.

It is desirable, therefore, for adhesive media to have improved wetting and adhesion properties. It would be further desirable to improve wetting and adhesion properties using inexpensive and/or environmentally friendly solutions Thus, there is a need to overcome these and other problems of the prior art and to provide adhesive media with improved wetting and adhesion properties as compared with conventional adhesive media.

SUMMARY

According to various embodiments, the present teachings include a method for treating a xerographic printed substrate comprising providing a printed substrate; providing an enzyme solution comprising at least one hydrocarbon-degrading enzyme; applying the enzyme solution over at least one surface of the printed substrate to form an enzyme-treated substrate; and heating the enzyme-treated substrate by passing the substrate through heated fuser members to form a treated xerographic printed substrate.

According to various embodiments, the present teachings also include a method of making an adhesive medium comprising providing a printed substrate comprising residual fuser oil contamination; providing an enzyme solution comprising at least one hydrocarbon-degrading enzyme; applying the enzyme solution over at least one surface of the printed substrate to form an enzyme-treated substrate; heating the enzyme-treated substrate by passing the substrate through heated fuser members; and applying adhesive over at least one surface of the enzyme-treated substrate to form an adhesive medium.

According to various embodiments, the present teachings further include an image forming apparatus comprising an electrographic photoreceptor; a charging unit for charging the photoreceptor; an exposure unit for exposing the charged photoreceptor to form an electrostatic image; a development unit for developing the electrostatic latent image; a transfer unit for transferring the toner image on a surface of a paper; a fusing unit for fixing the toner image on the surface of the paper, wherein the surface of the paper comprises fuser oil contamination; and an enzyme application unit for applying an enzyme treatment to the contaminated surface of the paper, Wherein the enzyme treatment comprises at least one hydrocarbon-degrading enzyme.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
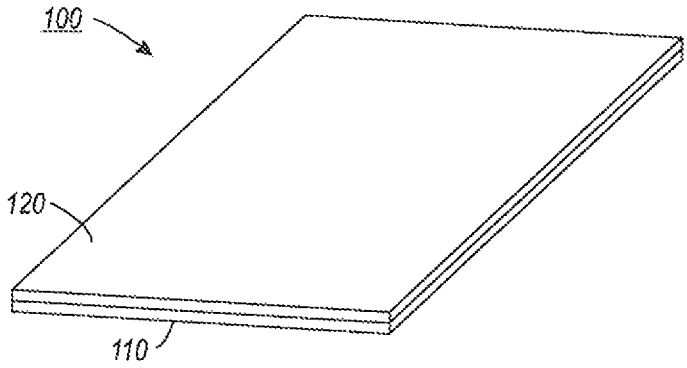
FIG. 1 depicts an exemplary portion of an enzyme-treated substrate in accordance with various embodiments of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be, made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and which are shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Exemplary embodiments provide adhesive media and methods for producing adhesive media including an enzyme treatment. In embodiments, the enzyme treatment can break down surface hydrocarbons present on a printed substrate that has passed through fuser members having fuser oil on a surface thereof.

As explained above, release agents are applied to the fuser roll to provide the release of a substrate containing an image thereon from the fuser roll after the toner image has been formed on the substrate. Thus, xerographic prints may be contaminated by a release agent such as amino-functionalized PDMS fuser oil due to the printing process. Some release agent may remain on a toner image that may cover any portion of the print and on the substrate itself. In other words, some release agent may remain on a final substrate having an image thereon and may at least partially cover a substrate having no toner image or a substrate having a toner image thereon. "Partially" refers to the release agent covering from above 0 percent to less than 100 percent of the substrate, such as from about 10 percent to about 90 percent or from about 20 percent to about 80 percent of the substrate. The release agent may chemically bond to the surface of the prints because of the reactive functional group such as amino- or mercapto-functional group in fuser oil during fusing process at high pressure and high temperature. The surface free energy (SFE) of the prints may thus dramatically drop from a range of higher than about 30 $mN/m^2$ for substrates such as paper to a range of from about 8 $mN/m^2$ to less than about 30 $mN/m^2$. Generally, commercially available hot melt adhesives bind to substrates having a SFE higher than about 30 $mN/m^2$. Thus, the oil contamination on the print lowers the SFE of the print and has a negative impact on a variety of applications such as bookbinding, laminating, thermal transfer printing of bar codes, check post encoding and pressure sealed mailers.

Any release agent remaining on the substrate, with or without a toner image thereon, may be detrimental to an adhesive attempting to adhere to the substrate with or without a toner image thereon. This is particularly important when the substrate is to be laminated or coated with a hot melt adhesive, such as an adhesive used in bookbinding. This release agent may also prevent materials utilizing adhesives, for example, POST-IT® notes, from adhering to the substrate.

Release agents used to help with releasing a substrate from a fuser roll in an imaging device include poly-ogranofunctional siloxanes, such as amino-functional silicone oils, such as methyl aminopropyl methyl siloxane, ethyl aminopropyl methyl siloxane, benzyl aminopropyl methyl siloxane, dodecyl aminopropyl methyl siloxane, aminopropyl methyl siloxane, and the like. In particular, the application of polydimethylsiloxane (PDMS) oil used commonly for release in xerographic fusing reduces the surface energy of the printed substrate. The effect is particularly strong in the case of amino-functionalized PDMS oil due to the hydrogen bonding at the paper/oil interface restricting diffusion of the oil below the paper surface. As a result the surface energy of the paper substrate is reduced, and many applications that involve adhesion to the print are adversely impacted. The present embodiments demonstrate the ability to increase the surface free energy of oil contaminated substrates (e.g., xerographic prints) through the application of an enzyme treatment to the oil contaminated substrate.

FIG. 1A depicts a portion of an exemplary enzyme-treated substrate 100 in accordance with various embodiments of the present teachings. It should be readily apparent to one of ordinary skill in the art that the enzyme-treated substrate 100 depicted in FIG. 1A represents a generalized schematic illustration and that other components can be added or existing components can be removed or modified.

As shown, the enzyme-treated substrate 100 can include a substrate 110 and an enzyme treatment 120 disposed over the substrate 110. In an embodiment, the enzyme treatment 120 can be disposed over the substrate 110 on a surface having hydrocarbon contamination. The surface hydrocarbon contamination can derive from fuser oils, such as amino functional, organopolysiloxane, and mercapto functional oil compositions.

In various embodiments, the substrate 110 can be made of a flexible or a rigid material and can be transparent or opaque. The substrate 110 can include, for example, any suitable material such as paper, wood, glass, ceramics, plastics, fabrics, textile products, polymeric films, inorganic substrates such as metals, and the like. The paper can include, for example, plain papers such as XEROX papers, ruled notebook paper, bond paper, silica coated papers such as Sharp Company silica coated paper, Jujo paper, and the like. The plastic can include clear, translucent, or opaque plastics, for example, a plastic film made of polyethylene, polyethylene terepthalate, polyethylene naphthalate, polystyrene, polycarbonate, or polyethersulfone. The substrate 110, such as a sheet of paper, can be either blank or have a printed toner image thereon.

In various embodiments, the substrate 110 can be a single layer or multi-layer, where each single or multi layer is coated or uncoated, and can have a thickness, for example, ranging from about 0.3 mm to about 5 mm. The enzyme treatment 120 can be coated on to the substrate 120, for example, a porous substrate such as paper. In various embodiments, the enzyme treatment 120 can be applied uniformly to the substrate 110 via spraying, for example by airbrush, aerosolizer, spray nozzle, and the like. In other embodiments, the enzyme treatment 120 can be applied uniformly to the substrate 110 by direct marking technologies and the like. Various techniques for direct marking are well understood in the art, for example piezo or thermal inkjet direct marking. The enzyme treatment 120 can also be applied to the substrate 110 via a porous contacting roll, and the like, that has adsorbed enzyme treatment 120 into its pores. Alternatively, the enzyme treatment 120 can be applied with a hydrophilic non-porous contacting roll, a microtextured roll, and the like, that has a thin layer of the enzyme treatment 120 coated on the surface.

The enzyme treatment 120 can include, for example, an aqueous solution including a hydrocarbon-degrading enzyme. In an embodiment, suitable hydrocarbon-degrading enzymes include lipases, oxidases, dehydrogenases, hydroxylases, oxygenases, and the like, and combinations thereof. Preferred hydrocarbon-degrading enzymes include lipases, monooxygenases, dioxygenases, monomethanoxygenases, alcohol dehydrogenases, aldehyde dehydrogenases, acetaldehyde dehydrogenases, paraffin hydroxylases, hydrolase-aldolases, and the like, and combinations thereof. While not intended to be limited by theory, it is believed that the hydrocarbon-degrading enzymes break down hydrocarbons into short-chain fatty acids that can be more easily solubilized and removed from the substrate surface. In aspects, other enzymes, such as proteases, amylases, cellulases, and the like, and mixtures thereof, can be present with the hydrocarbon-degrading enzymes in the enzyme solution.

In an embodiment, the hydrocarbon-degrading enzymes can be extracted and isolated from microorganisms and incorporated into the enzyme solution as a powder or aqueous solution. In another embodiment, the hydrocarbon-degrading enzymes can be secreted by live microorganisms present in the enzyme solution.

Suitable microorganisms include Gram-positive and Gram-negative bacteria, including endospores thereof; fungi; yeast; and combinations thereof. Exemplary bacteria include *Acetobacter* spp., *Anthrobacter* spp., *Acinetobacter* spp., *Actinomyces* spp., *Alcaligenes* spp., *Bacillus* spp., *Beneckea* spp., *Corynebacterium* spp., *Flavobacterium* spp., *Mycobacterium* spp., *Nocardia* spp., *Pseudomonas* spp., *Rhadococcus* spp., *Xanthomonas* spp., and the like, and combinations thereof; preferably, *Pseudomonas* spp., *Anthrobacter* spp., *Rhadococcus* spp., and combinations thereof. Exemplary yeast include *Candida* spp., *Crytococcus* spp., *Debaryomyces* spp., *Hansenula* spp., *Pichia* spp., *Rhodotorula* spp., *Sporobolomyces* spp., *Torulopsis* spp., *Trichosporon* spp., and the like, and combinations thereof; preferably *Candida* spp. Exemplary fungi include *Aspergillus* spp., *Cladosporium* spp., *Corollaspora* spp., *Dendryphiella* spp., *Gliocladium* spp., *Lulworthia* spp., *Penicillium* spp., *Varicospora* spp., and the like, and combinations thereof; preferably, *Aspergillus* spp., *Penicillium* spp., and combinations thereof. The microorganisms can naturally express hydrocarbon-degrading enzymes or be genetically modified to express hydrocarbon-degrading enzymes in greater quantity than native, non-genetically-modified microorganisms.

In an embodiment, the enzyme solution can be provided as a concentrate and diluted with water to produce the enzyme treatment 120. The enzyme treatment 120 can include the enzyme concentrate in an amount ranging from about 1 to about 90% by volume, for example from about 3 to about 70% by volume or about, 5 to about 50% by volume of the total enzyme treatment. Commercially available concentrated enzyme solutions include EATOILST™ products, such as BT200™, by WorldWare Enterprises Ltd. of Ontario, Canada.

In various embodiments, the enzyme treatment 120 can further include at least one surfactant. Exemplary surfactants include alkylphenol ethoxylates, alkaline metal salts of alkane sulfonic acid, alkanolamines, and mixtures thereof. While not intended to be limited by theory, it is believed the surfactants can solubilize short-chain fatty acids produced by the above enzymes as a result of hydrocarbon degradation, and remove the short-chain fatty acids from the substrate surface. The surfactant can be present in the enzyme treatment 120 in an amount ranging from about 0.5 to about 20 percent by weight, for example, from about 1 to about 10 percent by weight, such as from about 1 to about 5 percent by weight of the total enzyme solution.

Suitable alkylphenol ethoxylates can have the general formula $RC_6H_4(OCH_2CH_2)_xOH$, wherein R is a long chain aliphatic group comprising from about 7 to about 60, such as from about 10 to about 40, for example from about 20 to about 30 carbon atoms, and x can range from about 1 to about 12, such as from about 5 to about 10, for example from about 7 to about 10. The R group can be either straight or branched, preferably nonyl or octyl, and can be attached to various positions on the aromatic ring structure. In an embodiment, both a relatively low molecular weight alkylphenol ethoxylate (e.g., x can range from about 1 to about 6) and a relatively high molecular weight alkylphenol ethoxylate (e.g., x can range from about 8 to about 12) can be used. While not intended to be limited by theory, it is believed that the lower molecular weight alkylphenol ethoxylate can assist in the removal and/or solubilization of higher molecular weight hydrocarbons and that the higher molecular weight alkylphenol ethoxylate can assist in the removal and/or solubilization of lower molecular weight hydrocarbons.

Suitable alkaline metal salts of alkane sulfonic acid can have of the general formula $RSO_3^-M^+$ and $ArSO_3^-M^+$, R is a long chain aliphatic group comprising from about 7 to about 60, such as from about 10 to about 40, for example from about 20 to about 30 carbon atoms, Ar is a substituted or unsubstituted aromatic group, and $M^+$ is an alkaline metal cation, preferably sodium and potassium. Suitable $RSO_3^-$ and $ArSO_3^-$ anions include, for example, olefin sulfonates, aliphatic sulfonates, benzenesulfonate, toluenesulfonate, dodecylbenzenesulfonate, and the like. While not intending to be limited by theory, it is believed that alkaline metal salts of alkane sulfonic acid can provide detergency and help prevent re-adherence of hydrocarbons to the substrate surface after removal. Preferred alkaline metal salts of alkane sulfonic acid include sodium salts of substituted benzenesulfonate such as p-toluenesulfonate, dodecylbenzenesulfonate, and the like, or primary alkane sulfonate, and combinations thereof.

Suitable alkanolamines can have the general formula $(HO(CH_2)_z)_{3-y}NH_y$, wherein z ranges from about 2 to about 20, for example from about 2 to about 10, such as from about 2 to about 6, and y is 0, 1, or 2. Preferred alkanolamines include trialkanolamines of the formula $(HO(CH_2)_z)_3NH$, wherein z ranges from about 2 to about 6. In an aspect, the alkanolamine can be triethanolamine. While not intended to be limited by theory, it is believed that, like alkaline metal salts of alkane sulfonic acid, the alkanolamines can provide detergency and help prevent re-adherence of hydrocarbons to the substrate surface after removal.

Figure 2:
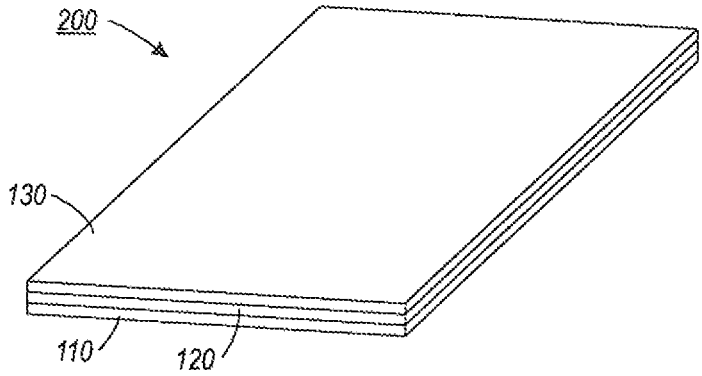
FIG. 2 depicts an exemplary portion of an adhesive medium in accordance with various embodiments of the present teachings.

FIG. 2 depicts an exemplary adhesive medium 200 in accordance with various embodiments of the present teachings.

As shown, the adhesive medium 200 can include a substrate 110, an enzyme treatment 120 disposed over the substrate 110, and an adhesive 130 disposed over the substrate after the enzyme treatment 120. In an embodiment, the enzyme treatment 120 can be disposed over the substrate 110 on a surface, having surface hydrocarbon contamination, and the adhesive 130 can be disposed over the substrate after the enzyme treatment 120. The surface hydrocarbon contamination can derive from fuser oils, such as amino functional, organopolysiloxane, and mercapto functional oil compositions.

In embodiments, the adhesive can include hot melt adhesives suitable for bookbinding, such as those based on ethylene vinyl acetate (EVA) copolymers; polyurethanes (PUR), styrenic block copolymers (SBC), and the like; high tack adhesives comprising an adhesive material or formulation which, when heated and activated, remains highly viscous and somewhat immobile so that a definite amount of pressure and/or heat is necessary for the substrate to adhere a surface; and low tack adhesives comprising an adhesive material or formulation which, when heated and activated, becomes fairly molten or fluid thereby enabling substrate bonding to a surface with minimum application of pressure or heat. Preferably, the adhesive is a hot melt adhesive. An example of commercially available hot melt adhesives includes US661 adhesive (available from United States Adhesives, Chicago, Ill.) having a viscosity around 4,000 Cp when heated at 175° C.

According to present embodiments, the surface free energy of an oil contaminated substrate can be substantially increased from about 13 mN/m to about 45 mN/m as a result of the enzyme treatment 120. That is, the SFE of an oil contaminated substrate can be about 13 mN/m before the enzyme treatment; after the enzyme treatment, the SFE of the substrate can be dramatically increased to about 45 mN/m. The surface energy of the substrate can be determined from contact angle values of a first standard testing liquid and a second standard testing liquid with known surface tensions, wherein the first standard testing liquid is polar and the second testing liquid is dispersive. However, the surface energy can also be calculated by other means known in the art. In one embodiment, the first standard testing liquid is water and the second standard testing liquid is diiodomethane. As measured, the surface free energy of an oil contaminated substrate can be significantly increased due to the enzyme treatment 120, from about 10 mN/m to about 45 mN/m, or from about 13 mN/m to about 40 mN/m, or from about 18 mN/m to about 35 mN/m, as calculated from the contact angle values of water and diiodomethane. In other words, the SFE of the paper before enzyme treatment can be about 10 mN/m or about 13 mN/m or about 18 mN/m; after enzyme treatment, the SFE of the paper can be about 45 mM/m or about 40 mN/m or about 35 mM/m. The total surface free energy of an enzyme treated substrate can range from about 20 mN/m to about 45 mN/m, such as from about 25 mN/m to about 40 mN/m, for example from about 30 mN to about 35 mN/m, as calculated from the contact angle values of water and diiodomethane. Additionally, the polar surface energy component of the enzyme treated substrate can be significantly increased from about 0.0.5 mN/m to about 10 mN/m as calculated from the contact angle values of water and diiodomethane. While not intended to be limited by theory, the increase in the polar surface energy component can be associated with excellent adhesion of enzyme treated xerographic prints as, exhibited by an increase in the adhesive bond paper fiber tear measured on a non-imaged area from about 0% up to about 100% as a result of the enzyme treatment 120.

Another embodiment is a xerographic print comprising a substrate, which may be coated or uncoated paper for example, with a toner-based image printed thereon, including low surface energy regions resulting from the application of fuser oil, which has been treated with the enzyme treatment 120. The print specified in this embodiment can exhibit excellent wetting and adhesion in a range of typical end-use applications as a result of the enzyme treatment.

For example, in one embodiment, there is provided a xerographic print comprising a paper substrate, a fused toner image on the paper substrate containing residual fuser oil contamination, and an enzyme treatment 120 comprising at least one hydrocarbon-degrading enzyme. The surface energy of the xerographic print after the enzyme treatment increases significantly as compared to the surface energy of the xerographic print prior to the enzyme treatment and, as a result of the treatment, the xerographic print displays excellent adhesion. The xerographic print may contain residual fuser oil being functionalized or non-functionalized oil ranging from about 2 mg/copy to about 20 mg/copy. In such embodiments, the surface energy of the xerographic print (e.g., at the oil contaminated non-image areas) can be significantly increased from about 10 mN/m to about 45 mN/m, or from about 13 mN/m to about 40 mN/m, or from about 18 mN/m to about 35 mN/m, as a result of the enzyme treatment 120. That is, the SFE of the paper before the enzyme treatment can be about 10 mN/m or about 13 mN/m or about 18 mN/m; after the enzyme treatment, the SFE of the paper can be about 45 mM/m or about 40 mN/m or about 35 mM/m. In addition, such xerographic prints can exhibit excellent adhesion by an increase in the adhesive bond paper fiber tear measured on a non-image area from about 0% up to about 100% as a result of the enzyme treatment 120. The total surface free energy of the xerographic print after enzyme treatment can range from about 20 mN/m to about 45 mN/m, such as from about 25 mN/m to about 40 mN/m, for example from about 30 mN to about 35 mN/m, as calculated from the contact angle values of water and diiodomethane. Additionally, the polar surface energy component of the enzyme treated xerographic print can be significantly increased from about 0.05 mN/m to about 20 mN/m as calculated from the contact angle values of water and diiodomethane.

In a further embodiment is provided an image forming apparatus comprising an electrographic photoreceptor; a charging unit for charging the photoreceptor; an exposure unit for exposing the charged photoreceptor to form an electrostatic latent image; a development unit for developing the electrostatic latent image; a transfer unit for transferring the toner image on a surface of a paper; a fusing unit for fixing the toner image on the surface of the paper, wherein the surface of the paper comprises fuser oil contamination; and an enzyme application unit for applying an enzyme treatment to the contaminated surface of the paper, wherein the enzyme treatment comprises at least one hydrocarbon-degrading enzyme.

The image forming apparatus can be any apparatus known in the art for printing xerographic images. In an aspect, the image forming apparatus can include an electrographic photoreceptor including a conductive support and a photosensitive layer disposed on the conductive support. The photosensitive layer can include a charge generation layer and a charge transport layer. The charging unit can uniformly charge the charge generation layer. The charged electrographic photoreceptor can be exposed to light and an electrostatic latent image can be formed on the photoreceptor. The toner image can be developed by a development unit comprising toner particles of opposite charge to the electrostatic latent image charge, resulting in toner particles being attracted to the imaging device to further form printed images The toner images can be transferred to a surface of a receiving substrate, such as paper, by a transfer unit, and fixed on the substrate by a fusing unit utilizing a suitable fusing technique, such as involving the application of heat and pressure. The surface of the paper can comprise residual fuser oil contamination as described above, for example from about 2 mg/copy to about 20 mg/copy. An enzyme treatment comprising at least one hydrocarbon-degrading enzyme can be applied, for example by spraying and the like, to the contaminated surface of the paper by an enzyme application unit. The enzyme treatment is as described above.

After the enzyme treatment, the surface energy of the paper substrate (e.g., on the oil contaminated non-image areas) can be significantly increased from about 10 mN/m to about 45 mN/m, or from about 13 mN/m to about 40 mN/m, or from about 18 mN/m to about 35 mN/m, as a result of the enzyme treatment 120. In other words, the SFE of the paper before the enzyme treatment can be about 10 mN/m or about 13 mN/m or about 18 mN/m; after the enzyme treatment, the SFE of the paper can be about 45 mM/m or about 40 mN/m or about 35 mM/m. In addition, such papers can exhibit excellent adhesion by an increase in the adhesive bond paper fiber tear measured on a non-image area from about 0% up to about 100% as a result of the enzyme treatment 120. The total surface free energy of the paper after enzyme treatment can range from about 20 mN/m to about 45 mN/m, such as from about 25 mN/m to about 40 mN/m, for example from about 30 mN to about 35 mN/m, as calculated from the contact angle values of water and diiodomethane. Additionally, the polar surface energy component of the enzyme treated paper can be significantly increased from about 0.05 mN/m to about 20 mN/m as calculated from the contact angle values of water and diiodomethane.

Figure 3:
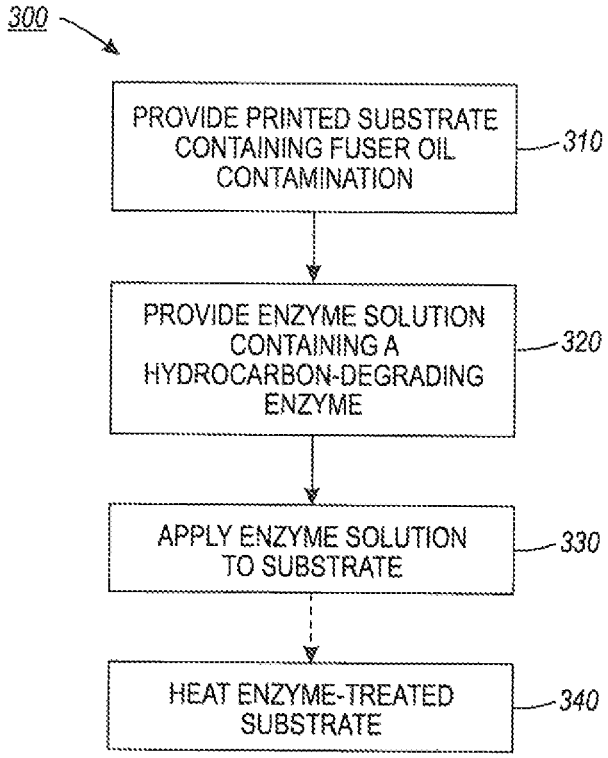
FIG. 3 depicts an exemplary method 300 for treating a xerographic printed substrate in accordance with various embodiments of the present teachings.

FIG. 3 depicts an exemplary method 300 for treating a xerographic printed substrate in accordance with various embodiments of the present teachings.

At 310, a printed substrate can be provided as disclosed herein. Preferably, at least one surface of the printed substrate comprises a fused toner image on the paper substrate comprising residual fuser oil contamination, such as functionalized or non-functionalized fuser oil ranging from about 2 mg/copy to about 20 mg/copy.

At 320, an enzyme solution comprising at least one hydrocarbon-degrading enzyme can be provided as disclosed herein. The at least one hydrocarbon-degrading enzyme can be any as previously discussed.

At 330, the enzyme solution can be applied over at, least one surface of the printed substrate to form an enzyme-treated substrate. The enzyme solution can be applied by any manner known in the art, for example by spraying (e.g. by airbrush, aerosolizer, spray nozzle, and the like). In other embodiments, the enzyme solution can be applied uniformly by direct marking technologies and the like. Various techniques for direct marking are well understood in the art, for example piezo or thermal inkjet direct marking. The enzyme solution can also be applied via a porous contacting roll, and the like, that has adsorbed enzyme solution into its pores. Alternatively, the solution can be applied with a hydrophilic non-porous contacting roll, a microtextured roll, and the like, that has a thin layer of the enzyme solution coated on the surface.

The surface energy of the enzyme-treated substrate (e.g., at the oil contaminated non-image areas) can be significantly increased from about 10 mN/m prior to the enzyme treatment to about 45 mN/m after the enzyme treatment, or from about 13 mN/m before the enzyme treatment to about 40 mN/m after the enzyme treatment, or from about 18 mN/m before the enzyme treatment to about 35 mN/m after the enzyme treatment, as a consequence of the enzyme treatment 120.

Optionally, the enzyme-treated substrate can be heated. At optional step 340, the enzyme-treated substrate can be passed through heated fuser members, for example at a temperature ranging from about 140° C. to about 200° C., such as from about 150° C. to about 190° C., for example at about 180° C. The enzyme-treated substrate can be passed through heated fuser members at a roll speed of about 600 to about 2000 rpm, for example from about 650 to about 1500 rpm, such as from about 700 to about 1400 rpm. Heating the enzyme-treated substrate to a temperature of 140° C. and above denatures the hydrocarbon-degrading enzymes, halting enzymatic activity.

Figure 4:
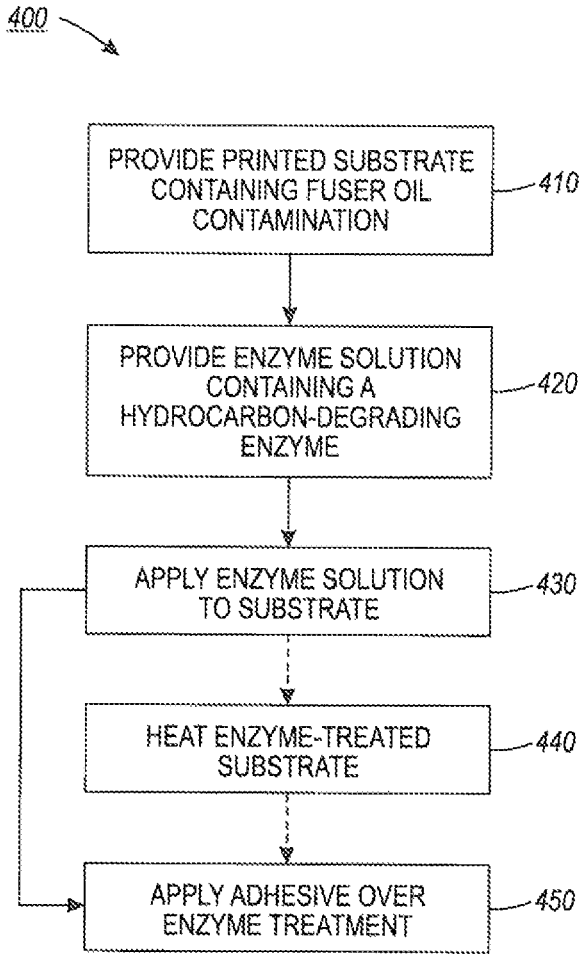
FIG. 4 depicts an exemplary method 400 for making an adhesive medium in accordance with various embodiments of the present teachings.

FIG. 4 depicts an exemplary method 400 for making an adhesive medium in accordance with various embodiments of the present teachings.

At 410, a printed substrate can be provided as disclosed herein. Preferably, at least one surface of the printed substrate, comprises a fused toner image on the paper substrate comprising residual fuser oil contamination, such as functionalized or non-functionalized fuser oil ranging from about 2 mg/copy to about 20 mg/copy.

At 420, an enzyme solution comprising at least one hydrocarbon-degrading enzyme can be provided as disclosed herein. The at least one hydrocarbon-degrading, enzyme can be any as previously discussed.

At 430, the enzyme solution can be applied by any manner known in the art, for example by spraying (e.g. by airbrush, aerosolizer, spray nozzle, and the like), over at least one surface of the printed substrate to form an enzyme-treated substrate. The surface energy of the enzyme-treated substrate (e.g., on the oil contaminated non-image areas) can be significantly increased from about 10 mN/m to about 45 mN/m, or from about 13 mN/m to about 40 mN/m, or from about 18 mN/m to about 35 mN/m, as a consequence of the enzyme treatment 120.

Optionally, the enzyme-treated substrate can be heated. At optional step 440, the enzyme-treated substrate can be passed through heated fuser members, for example at a temperature ranging from about 140° C. to about 200° C., such as from about 150° C. to about 190° C., for example at about 180° C. Heating the enzyme-treated substrate to a temperature of 140° C. and above denatures the hydrocarbon-degrading enzymes, resulting in loss of enzymatic activity. The total drying time can range from about 1 to about 35 seconds, such as from about 10 to about 30 seconds, for example from about 15 to about 25 seconds. If the enzyme treated substrate is not heated, the method can proceed directly from step 430 to step 450.

At 450, an adhesive can be applied over at least one treated surface of the enzyme-treated substrate to form an adhesive medium. The adhesive can be any as previously discussed, for example a hot melt adhesive. The adhesive medium can exhibit excellent adhesion as shown by an increase in the adhesive bond paper fiber tear measured on a non-image area from about 0% up to about 100% as a result of the enzyme treatment 120.

As used herein, "total drying time" is understood to mean the amount of time after the enzyme solution has been applied until an adhesive is applied. The total drying time can range from about 1 to about 35 seconds, such as from about 10 to about 30 seconds, for example from about 15 to about 25 seconds. While not intended to be limited by theory, it is believed that the total drying time can be an indicator of how fast the enzymes can degrade the fuser oil, with a shorter drying time being associated with faster enzymatic activity. The treated xerographic printed substrate can exhibit excellent adhesion as shown by an increase in the adhesive bond paper fiber tear measured on a non-image area from about 0% up to about 100% as a result of the enzyme treatment 120.

The following examples are illustrative of various embodiments and their advantageous properties, and are not to be taken as limiting the disclosure or claims in any way.

EXAMPLES

The following gluability and surface free energy tests were carried out using two different types of commercially available coated papers (Paper A and Paper B). However, the uncoated side of these papers are also contemplated by this disclosure, as a result of the exposure to an enzyme treatment Oil contaminated sheets were produced by running the blank paper substrate through a Xerox printer running with either Oil C (an amino fuser oil with high amine content) or Oil D (a functionalized fuser oil with low amine content) (both available from Wacker Chemie AG, Munich, Germany). The amount, of oil on each letter size sheet was around 9-11, mg/Copy as measured by ICP (Inductively Coupled Plasma) and only the uncoated side of the paper as contaminated in the process. It is noted that the present embodiments can also be used with various other types of printers and paper substrates not disclosed herein.

Example 1

Gluability Test

An enzyme solution was prepared by adding 1 part of an enzyme concentrate (BT200™, available from Eatoils™, Ontario, Canada) to 3 parts of water. The enzyme solution was uniformly sprayed onto the contaminated paper surfaces using an airbrush. The enzyme-treated papers were allowed to air dry for about 14 to about 29 seconds and then passed through a fusing fixture comprising two fuser rolls under heat at about 180° C. and pressure.

About four to five grams of a commercially available hot melt, adhesive, US661 adhesive (available from United States Adhesives, Chicago, Ill.), was heated to about 175° C. with a viscosity of about 4,000 Cp and manually applied to enzyme, treated and untreated papers using a Meyer Rod coating machine, specifically a #3 Meyer Rod.

A corresponding piece of the same paper was placed on top of the liquid adhesive within a few seconds, resulting in a sandwich formation. The sandwich was immediately placed in a sealer under compression pressure at 5 psi for a period of 3 seconds and then removed and allowed to cool. The portion compressed by the sealer was cut into approximately 1.5×5 inch samples and left to set at room temperature for 24 hours before they were peeled. Fiber tear was measured by manually separating the pieces of the sample sandwich and visually inspecting the results. 0% indicates no paper fiber tear (undesirable result) and 100% indicates complete adhesion and tear (desirable result). For example, no fiber tear would mean that the two pieces of paper can easily be separated without any tearing due to lack of adhesion. 100% means complete adhesion and thus tearing of the two pieces of paper when they were manually separated. Fiber tear tests were conducted twice for each sample and the average fiber tear was reported.

The results are shown in Table 1 below:

TABLE 1

| Sample | Treated/Untreated | Total Drying Time (sec) | Drying Temp ° C. | Roll Speed (rpm) | Fiber Tear Test-1 (%) | Fiber Tear Test-2 (%) | Fiber-Tear Average |
|---|---|---|---|---|---|---|---|
| Paper A with Oil D | Untreated | | | | 0 | 0 | 0 |
| Paper A with Oil C | Untreated | | | | 0 | 0 | 0 |
| Paper B with Oil D | Untreated | | | | 0 | 0 | 0 |
| Paper B with Oil C | Untreated | | | | 0 | 0 | 0 |
| Paper A with Oil C | Treated | 18 | 180 | 700 | 100 | 95 | 97.5 |
| Paper A with Oil C | Treated | 14 | 180 | 1400 | 70 | 60 | 70 |
| Paper B with Oil C | Treated | 29 | 180 | 700 | 100 | 100 | 100 |
| Paper B with Oil C | Treated | 24 | 180 | 1400 | 100 | 75 | 87.5 |
| Paper A with Oil D | Treated | 15 | 180 | 700 | 90 | 90 | 90 |
| Paper A with Oil D | Treated | 15 | 180 | 1400 | 100 | 100 | 100 |
| Paper B with Oil D | Treated | 24 | 180 | 700 | 95 | 100 | 97.5 |
| Paper B with Oil D | Treated | 23 | 180 | 1400 | 100 | 95 | 97.5 |

Greatly improved fiber tear due to the enzyme treatment of the oil contaminated papers is shown in Table 1. The experimental results show that papers treated with enzyme solutions demonstrated very good fiber tear for both papers and both fuser oils over a range of total drying times and roll speeds. In comparison, the untreated papers demonstrated 0% fiber tear meaning that the two pieces of paper were easily separated without any tearing due to lack of adhesion, which is an undesirable result.

Example 2

Surface Free Energy Test

The contact angles of two standard testing liquids (water and diiodomethane) with known surface tensions were measured on the surface of each paper type for untreated oil contaminated papers and enzyme-treated oil contaminated papers. However, these measurements are not limited to the use of this particular set of liquids, as there is a variety of standard liquids with known properties that are suitable for this type of study. All measurements for untreated oil contaminated papers were conducted immediately after the papers passed through a printer. All measurements of enzyme-treated oil contaminated papers were conducted immediately after the enzyme-treated papers were passed through a fusing fixture comprising of two fuser rolls under heat (180° C.) and pressure. The contact angle data was collected after 0.5 seconds and 1.0 seconds from the moment the drop touched the respective surfaces. The measurement at 1.0 s provided a good equilibrium condition as the drop had sufficient time to "settle" and no spreading on the surface was observed after 1 second, whereas the measurement at 0.5 s provided a good initial condition. The contact angle results were used to calculate the surface free energy using Wu's geometric model. The surface free energy results (including dispersive and polar energy components and total SFE) are reported in Table 2 below:

TABLE 2

| | SURFACE FREE ENERGY (mN/m$^2$) | | | | | |
|---|---|---|---|---|---|---|
| | SFE - 0.5 s | | | SFE - 1.0 s | | |
| Sample | $\gamma^d_s$ | $\gamma^p_s$ | $\gamma^t_s$ | $\gamma^d_s$ | $\gamma^p_s$ | $\gamma^t_s$ |
| Paper A with Oil D_Untreated | 11.92803 | 0.619766 | 12.54799 | 11.74328 | 0.822048 | 12.56533 |
| Paper A with Oil D_Treated | 20.13153 | 13.05851 | 33.19003 | 20.16715 | 17.23255 | 37.39969 |
| Paper A with Oil C_Untreated | 11.98384 | 0.058288 | 12.04213 | 11.82978 | 0.088781 | 11.91856 |
| Paper A with Oil C_Treated | 11.9952 | 9.823383 | 21.81858 | 11.31898 | 13.38036 | 24.69934 |
| Paper B w/Oil D_Untreated | 13.86515 | 4.029984 | 17.89513 | 13.8684 | 4.045499 | 17.9139 |
| Paper B w/Oil D_Treated | 18.10697 | 16.0257 | 34.12366 | 19.26025 | 18.78129 | 38.04153 |
| Paper B w/Oil C_Untreated | 13.69409 | 0.109518 | 13.80001 | 13.63758 | 0.113062 | 13.75065 |
| Paper B w/Oil C_Treated | 16.69521 | 8.239618 | 24.93482 | 17.246 | 9.81024 | 27.05624 |

The effect of enzyme treatment on the surface energies (including dispersive and polar energy components) of the oil contaminated papers is significant. As seen in Table 2, the untreated oil contaminated papers have low surface free energies with total surface energies ranging from about 12 mN/m to about 18 mN/m. In comparison, the enzyme-treated oil contaminated papers demonstrated a dramatic increase in surface free energy with total surface energies ranging from about 20 mN/m to about 38 mN/m. Furthermore, the enzyme-treated oil contaminated papers demonstrated an increase in surface free energy for both types of papers, contaminated with both low and high amine content fuser oils.

An interesting observation is that the polar energy component significantly increased after enzyme treatment as compared to the polar energy component of untreated papers. For example, the polar energy component of Paper A with Oil D_Treated increased from 0.619766 mN/m$^2$ to 13.05851 mN/m at 0.5 s and from 0.822048 mN/m to 17.23255 mN/m after 1.0 s, demonstrating 13-fold and 17-fold increases in the polar energy components, respectively. The results show that the highest polar energy component of untreated papers at SFE 0.5 s was 4.029984 mN/m (for Paper B w/Oil D_Untreated). In comparison, the lowest polar energy component for treated papers at SFE 0.5 s was 8.239618 mN/m (for Paper B w/Oil C_Treated), at least a 2-fold increase over untreated papers. Likewise, the highest polar energy component of untreated papers at SFE 1.0 s was 4.045499 mN/m (for Paper B w/Oil D_Untreated), whereas the lowest polar energy component for treated papers at SFE 1.0 s was 9.81024 mN/m (for Paper B w/Oil C_Treated). As seen in Table 2, the polar energy components dramatically increased for both types of papers, with both fuser oils, over 0.5 s and 1.0 s.

Example 3

Six drops of an enzyme solution as prepared in Example 1 were applied to contaminated papers, which had about 15.9 At. % (atomic percent) fuser oil on the surface. The enzyme-treated papers were allowed to air dry for about ½ second to about 5 seconds. No heat was applied. After drying, the papers had about 6-7 At. % of fuser oil on the surface.

About four to five grams of a commercially available hot melt adhesive, US661 adhesive (available from United States Adhesives, Chicago, Ill.), were heated to about 175° C. with a viscosity of about 4,000 Cp and manually applied to the enzyme-treated papers.

Figure 5:
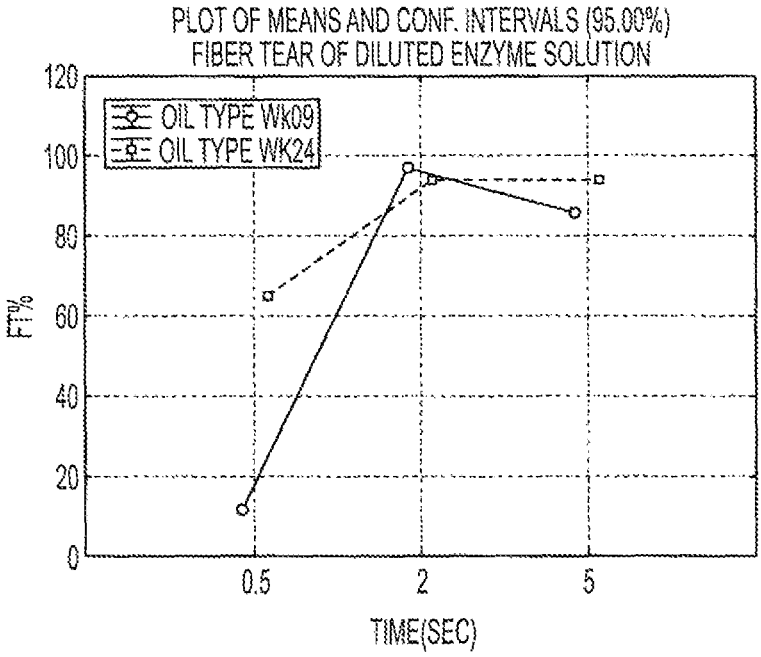
FIG. 5 depicts average fiber tear results of exemplary fiber tear tests in accordance with embodiments of the present teachings.

A corresponding piece of the same paper was placed on top of the liquid adhesive within a few seconds, resulting in a sandwich formation. The sandwich was placed under an aluminum block, under a 3 lb. load, for an amount of time. Fiber tear was measured by manually separating, the pieces of the sample sandwich and visually inspecting the results. 0% indicates no paper fiber tear (undesirable result) and 100% indicates complete adhesion and tear (desirable result). For example, no fiber tear would mean that the two pieces of paper can easily be separated without any tearing due to lack of adhesion. 100% means complete adhesion and thus tearing of the two pieces of paper when they were manually separated. Fiber tear tests were conducted twice for each sample and the average fiber tear are shown in FIG. 5.

The above results demonstrate that treating oil contaminated papers with an enzyme solution in the manner described herein provides an effective method which increases the surface energy of an oil contaminated print that exhibits significantly improved adhesion properties as a direct result of this treatment. Furthermore, the enzyme treatment disclosed herein provides a safe and green solution, as it is environmentally friendly, contains no solvents, and is biodegradable and non-flammable.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges, having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method of applying an adhesive over a printed substrate, the method comprising:

providing a printed substrate comprising a residual fuser oil contamination;

providing an enzyme solution capable of degrading the fuser oil contamination, the enzyme solution comprising at least one hydrocarbon-degrading enzyme;

applying the enzyme solution over at least one surface of the printed substrate contaminated with fuser oil to form an enzyme-treated substrate; and applying adhesive over the enzyme-treated substrate, wherein the enzyme-treated substrate comprises a surface free energy ranging from about 20 to about 45 m/Nm.

2. The method of claim 1, further comprising heating the enzyme-treated substrate by passing the substrate through heated fuser members, after applying the enzyme solution.

3. The method of claim 1, wherein the hydrocarbon-degrading enzyme is a lipase.

4. The method of claim 1, wherein the hydrocarbon-degrading enzyme is selected from the group consisting of a lipase, a dioxygenase, a monomethanoygenase, an alcohol dehydrogenase, an aldehyde dehydrogenase, an acetaldehyde dehydrogenase, a paraffin hydroxlase, and combinations thereof.

5. The method of claim 1, further comprising passing the enzyme-treated substrate through heated fuser members at a temperature ranging from about 140° C. to about 200° C.

6. A method of applying an adhesive to a printed paper substrate, the method comprising:

providing a printed paper substrate comprising a residual fuser oil contamination;

providing an enzyme solution comprising at least one hydrocarbon-degrading enzyme capable of degrading the fuser oil contamination, the hydrocarbon-degrading enzyme being selected from the group consisting of a lipase, a dioxygenase, a monomethanoygenase, an alcohol dehydrogenase, an aldehyde dehydrogenase, an acetaldehyde dehydrogenase, a paraffin hydroxylase, and combinations thereof;

applying the enzyme solution over at least one fuser oil contaminated surface of the printed paper substrate to form an enzyme-treated substrate; and after applying the enzyme solution, applying adhesive to the at least one surface of the enzyme-treated substrate, the adhesive being applied to the enzyme-treated substrate in a layered configuration suitable for book binding wherein the enzyme-treated substrate comprises a surface free energy ranging from about 20 to about 45 mN/m.

7. The method of claim 6, wherein the adhesive comprises a component selected from the group consisting of ethylene vinyl acetate (EVA) copolymers, polyurethanes (PUR) and styrenic block copolymers (SBC).

8. The method of claim 6, wherein the hydrocarbon-degrading enzyme is selected from the group consisting of a lipase, a dioxygenase, a monomethanoxygenase, an alcohol dehydrogenase, an aldehyde dehydrogenase, and combinations thereof.

9. The method of claim 6, wherein the applying of the enzyme solution is carried out by a method selected from the group consisting of spraying, direct marking and by application with a contacting roll.

10. A method for preparing a xerographic printed paper substrate for application of an adhesive, the method comprising:

providing a xerographic printed substrate comprising a residual fuser oil contamination;

providing an enzyme solution capable of degrading the fuser oil contamination, the enzyme solution, comprising at least one hydrocarbon-degrading enzyme; and applying the enzyme solution over at least one fuser oil contaminated surface of the xerographic printed paper substrate to form an enzyme-treated xerographic printed substrate wherein the enzyme-treated xerographic printed substrate comprises a surface free energy ranging from about to about 45 mN/m.

11. The method of claim 10, further comprising applying adhesive over the enzyme-treated xerogrpahic printed substrated.

12. The method of claim 10, wherein the hydrocarbon-degrading enzyme is a lipase.

13. The method of claim 10, wherein the hydrocarbon-degrading enzyme is selected from the group consist of a lipase, a dioxygenase, a monomethanoxygenase, an alcohol dehydrogenase, an aldehyde dehydrogenase, an acetaldehyde dehydrogenase, a paraffin hydroxylase, and combinations thereof.

14. The method of claim 13, wherein the enzyme solution comprises water and from about 1% to about 90% by volume of an enzyme concentrate.

15. The method of claim 14, wherein the enzyme solution further comprises at least one surfactant.

16. The method of claim 10, wherein the hydrocarbon-degrading enzyme is selected from the group consisting of a lipase, a monomethanoxygenase, an alcohol dehydrogenase, an aldehyde dehydrogenase, and combinations thereof.

17. The method of claim 16, wherein the applying of the enzyme solution is carried out by a method selected from the group consisting of spraying, direct marking and by application with a contacting roll.

18. The method of claim 10, wherein the adhesive and the printed substrate are suitable for one of book binding, laminating, thermal transfer printing of bar codes, and pressure sealing of mailers.

* * * * *